US010544011B2

(12) United States Patent
Nooren et al.

(10) Patent No.: US 10,544,011 B2
(45) Date of Patent: Jan. 28, 2020

(54) HOISTING FRAME FOR OVERWEIGHT LIFTING

(71) Applicant: Mammoet USA South, Inc., Rosharon, TX (US)

(72) Inventors: Piet Nooren, Angleton, TX (US); Thomas Lambooij, Schiedam (NL)

(73) Assignee: Mammoet USA South, Inc., Rosharon, TX (US)

( * ) Notice: Subject to any disclaimer, the term of this patent is extended or adjusted under 35 U.S.C. 154(b) by 427 days.

(21) Appl. No.: 15/370,862

(22) Filed: Dec. 6, 2016

(65) Prior Publication Data

US 2017/0158468 A1 Jun. 8, 2017

Related U.S. Application Data

(60) Provisional application No. 62/265,577, filed on Dec. 10, 2015, provisional application No. 62/263,837, filed on Dec. 7, 2015.

(51) Int. Cl.
*B66C 1/22* (2006.01)

(52) U.S. Cl.
CPC ..... *B66C 1/22* (2013.01)

(58) Field of Classification Search
CPC .. B66C 1/22; B66C 1/30; B66C 1/663; B66C 1/10; B66C 1/12; B66C 1/101; B66C 1/102; B66C 1/104
See application file for complete search history.

(56) References Cited

U.S. PATENT DOCUMENTS

| | | | | |
|---|---|---|---|---|
| 3,606,438 | A * | 9/1971 | Feczko | B66C 1/66 294/67.3 |
| 4,736,976 | A * | 4/1988 | Berzenye | B66C 1/14 294/81.56 |
| 4,973,795 | A * | 11/1990 | Sharpe | H02G 1/02 174/40 R |
| 7,159,912 | B2 * | 1/2007 | Gerhausser | B66C 1/12 294/81.2 |
| 9,316,208 | B2 * | 4/2016 | Friis | F03D 80/00 |
| 2013/0152431 | A1 * | 6/2013 | Buhse | E02F 3/58 37/399 |

* cited by examiner

*Primary Examiner* — Stephen A Vu
(74) *Attorney, Agent, or Firm* — Blank Rome LLP

(57) ABSTRACT

Provided are weight distribution hoisting brackets and methods of using such brackets that offset a lifting position to an upper lifting mechanism off a center line of a heavy load to be lifted enabling sharing of the weight of a load to be lifted between at least two lifting mechanisms such as cranes such that lifting mechanisms may be employed that have a lower lifting weight capacity than the weight of the load.

16 Claims, 14 Drawing Sheets

HOISTING FRAME FOR OVERWEIGHT LIFTING

CROSS REFERENCE TO RELATED APPLICATIONS

This application claims priority based on U.S. Provisional Application Ser. No. 62/263,837 filed Dec. 7, 2015 and U.S. Provisional Application Ser. No. 62/265,577 filed Dec. 10, 2015, both of which are incorporated herein by reference in their entireties.

FIELD OF THE INVENTION

This invention relates generally to apparatus and methods for lifting heavy vessels, particularly chemical reactor vessels and other particularly heavy loads using heavy lift cranes.

BACKGROUND OF THE INVENTION

Without limiting the scope of the invention, its background is described in connection with existing apparatus and methods for lifting tall heavy structures such as chemical reactor vessels. Typically a reactor vessel, which may weigh hundreds to thousands of tons, will be transported on heavy lift multi-axle carriers in a horizontal position to near the installation site. The reactor vessel must then be lifted into an upright position and permanently installed on its pad. Due to the extreme weight of the reactor vessel, specialized heavy lift cranes that are rated for the weight of the vessel must be employed to lift the vessel into an upright position. Problematically, cranes rated for the weight of the lift may not be available or may not exist for particularly heavy loads including specialized petrochemical reactor vessels.

Provided herein are novel lifting mechanisms that permit lifting of heavy loads that exceed the weight rating of the cranes to be employed.

BRIEF SUMMARY OF THE INVENTION

Disclosed herein are weight distribution hoisting frames and methods of using such frames that act to offset a top lifting position off of a longitudinal midline of an elongated load and thereby enable sharing of the weight of the load between at least two lifting apparatus with the result that no single lifting apparatus carries the whole weight of the load at any time. Thus, lifting apparatus, such as for example a main crane and a tail crane, may be employed that each have a lower rated lifting weight capacity than the total weight of the load.

In certain embodiments, a weight distribution hoisting frame is employed that includes a pair of trunion attachment arms that have distal and proximal ends respective to a lift position. The distal ends of the trunion attachment arms have holes that are dimension to fit over upper lift trunions that are located on opposite sides of the load. The trunion attachment arms are separated at a proximal end by a spreader bar that is designed to approximate an outer surface of the load. In certain embodiments, a pair of cradling chucks is affixed to the spreader bar that are adapted and dimensioned to closely oppose outer walls of the load and prevent shifting. The proximal ends of the trunion attachment arms are attached to links or shackles that swingably attach the trunion attachment arms to lift cables. Using the disclosed weight distribution hoist frame, the load lift point is displaced outward from a longitudinal midline of the load and towards the side of the load that rests against the spreader bar.

In certain embodiments the trunion attachment arms have one or more lift attachment holes that are placed inward towards a midline of the load respective to the spreader bar location. The position of the lift attachment hole to be used may be selected depending on the calculated load desired for the main lift apparatus and a tail lift apparatus as well as the permissible swing of the lifted load.

In certain embodiments a weight distribution hoisting frame is provided for lifting of a load such as a reactor vessel by one or more cranes, the frame comprising a spreader bar mounted between and separating a pair of trunion attachment arms, each arm having a proximal end that is rotatably affixed to an end of the spreader bar and comprising a lift cable attachment site and a distal end having a trunion capture hole, wherein the pair of trunion attachment arms are dimensioned to hold the spreader bar on a side of the vessel and wherein the hoisting frame displaces a lift position of the vessel away from a midline position and toward the spreader bar during lifting of the vessel. In some embodiments the trunion capture hole is an openable split ring that includes a trunion release cable or chain attachment. In certain embodiments the spreader bar is generally cylindrical or oval in cross-section while in other embodiments the spreader bar is square or rectangular. In certain embodiments, the spreader bar comprises cradling chucks dimensioned to fit against the vessel and keep the vessel centered on the spreader bar. In other embodiment the spreader bar is dimensioned to include a central curve dimensioned to fit against the load and keep a generally cylindrical load centered on the spreader bar.

In some embodiments the trunion attachment arms of the weight distribution hoisting frame are rotatably affixed to the spreader bar by a bearing bush while in other embodiments the trunion attachment arms are rotatably affixed to the spreader bar by an axle passing through the spreader bar and connecting one trunion attachment arm to the other trunion attachment arm. Links or shackles may be provided to swingably affix to the trunion attachment arms at the lift cable attachment sites.

In certain embodiments, the trunion attachment arms of the weight distribution hoisting frame include a plurality of lift cable attachment sites disposed between the distal and proximal ends of the attachment arms and selection of a given attachment hole site on each of the trunion attachment arms shifts a lift position of the vessel respective to a midline of the vessel.

In other embodiments, a weight distribution hoisting frame is provided that offsets a lift position of a load off of a midline position by providing lift cables attached to a spreader bar where the lift cables are of a length that prevents the spreader bar from passing over a head of the load but rather provides that the spreader bar will rest against a side of the load during the lift.

Also provided herein are methods of lifting a load using a plurality of cranes wherein the load is heavier than the weight capacity of any individual crane. In one such method, a weight distribution hoisting frame is attached to the load via lifting trunions affixed to a head portion of the load, wherein the weight distribution hoisting frame acts to shift a lift position of the load away from a midline position. In certain embodiments the frame includes a pair of vessel attachment arms, a plurality of lift cable attachment sites and a spreader bar attached between the pair of attachment arms. The vessel attachment arms are dimensioned to retain the spreader bar on one side of the vessel during the lift operation. In other embodiments the attachment arms are lift cables that are dimensioned to capture lift trunions on the load and hold a spreader bar against a side of the load. In still other embodiments, a lift cable embraces the load as a strap or cable running in a semi-circle from a first lift trunion to a second lift trunion on an opposite or contralateral side of the load. The lift strap or cable has lift attachment sites by which it is ultimately connected to a crane. In each of these hoist frame embodiments, lift cables are attached from a first of the plurality of cranes to the lift attachment sites on the weight distribution frame and the cables are tightened thereby moving a lift position of the load away from a midline of the load and toward the spreader bar or lift attachment sites. Lift cables are attached from a second of the plurality of cranes to lifting trunions affixed to a tail portion of the load. Once the cranes are engaged, the load is lifted, moved and positioned with the weight of the load distributed or shared by the plurality of cranes such that no single crane ever carries the entire weight of the load and the lift can be accomplished without a requirement for a single crane that is rated for the full weight of the load.

For a more complete understanding of the present invention, including features and advantages, reference is now made to the detailed description of the invention along with the accompanying figures.

DETAILED DESCRIPTION OF THE INVENTION

While the making and using of various embodiments of the present invention are discussed in detail below, it should be appreciated that the present invention provides many applicable inventive concepts which can be employed in a wide variety of specific contexts. The specific embodiment discussed herein are merely illustrative of specific ways to make and use the invention and do not delimit the scope of the invention.

The following examples are include for the sake of completeness of disclosure and to illustrate the methods of making the compositions and composites of the present invention as well as to present certain characteristics of the compositions. In no way are these examples intended to limit the scope or teaching of this disclosure.

Figures 1A, 1B:
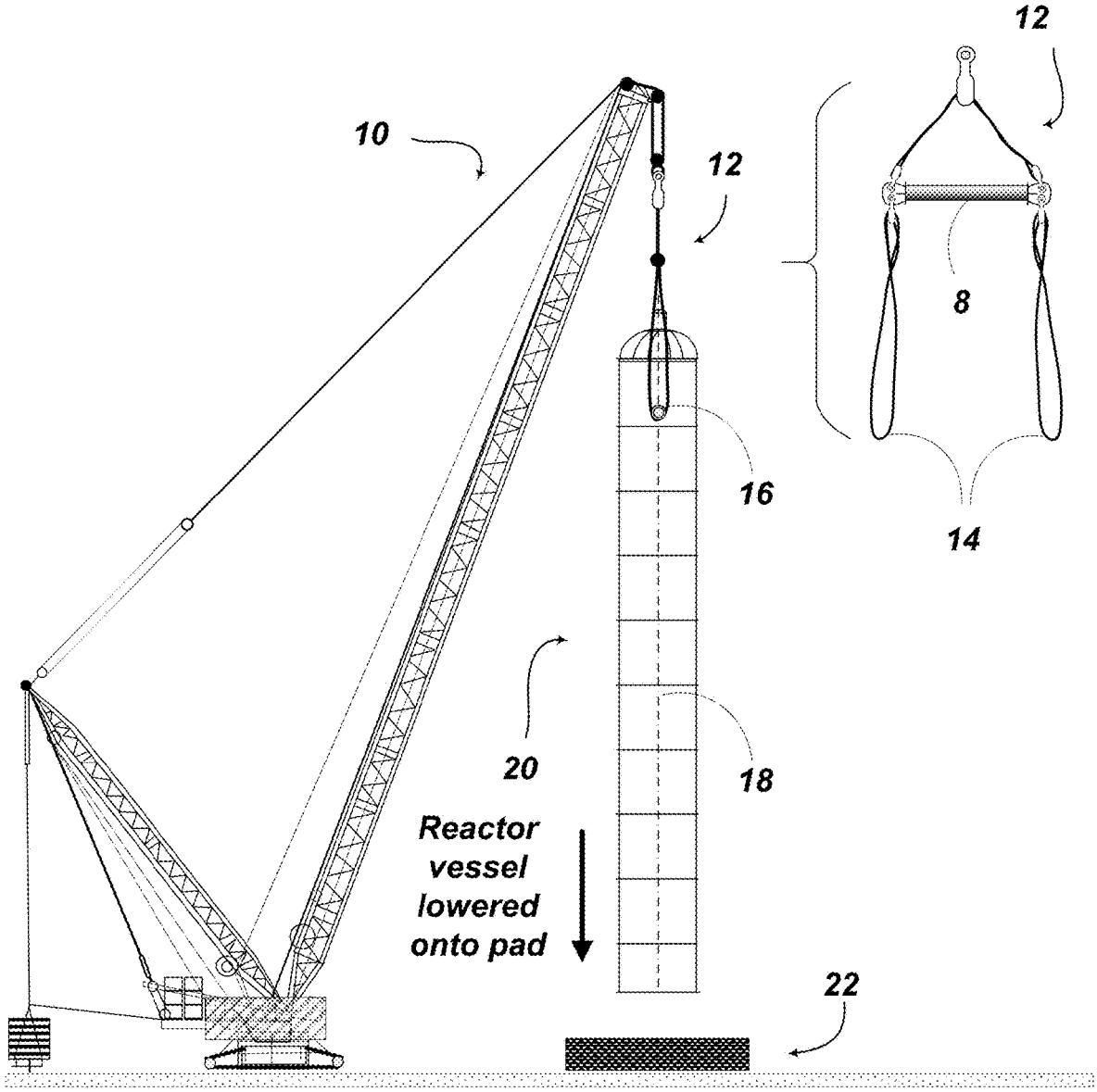
Fig. 1A PRIOR ART
Fig. 1B PRIOR ART
FIG. 1A illustrates a prior art lifting harness for lifting a reactor vessel onto its permanent pad using a heavy lift crane.
FIG. 1B illustrates an enlargement of the prior art lifting harness of FIG. 1A in frontal view.

Currently when heavy equipment such as for example, petrochemical reactor vessels are installed, a complex logistic problem is presented. The equipment is typically moved into position using multi-axle trailers that are either pulled by trucks or are self-propelled. Once near the installation pad, equipment such as reactor vessels must be hoisted off of delivery trailers and lifted upright into position to be permanently affixed to their custom engineered placement pads. Using current technology such as is depicted in FIG. 1A, a heavy lift crane 10 is employed that has a lift rating that equals or exceeds the weight of the reactor vessel 20. The depicted crane is a crawler crane but the same principal applies to fixed or vessel mounted ring cranes. The reactor vessel 20 will be constructed with top lift trunions 16 that are mounted on opposing sides of the vessel along a midline 18 of the vessel for lifting by lifting harness 12. FIG. 1B depicts one example of a prior art lifting harness such as in FIG. 1A in enlarged frontal view. Such prior art lifting harnesses such as lifting harness 12 will typically include heavy cables 14 separated by a spreader bar 8. Cables 14 are dimensioned to allow engagement of each of cables 14 under trunions 16 on opposite sides of the vessel and to position the spreader bar over the top of the vessel such that the lift position is at a vertical midline 18 of vessel 20. The cables 14 are lowered around trunions 16 and then pulled tight by the crane cabling. According to such a prior art arrangement, even where two cranes are employed, the vessel will hang directly down at some point in its installation with all of the weight of the vessel on the main crane. Such main crane must be rated to support the entire weight of the vessel. If underrated, the crane may tip over with disastrous results.

The present inventors appreciated a need to lift and install heavy equipment that would exceed the weight capacity of available cranes. Indeed for certain of such equipment there might be only a handful of cranes in the world that would be rated for the weight of the load and such might not be timely available or might not even exist for uniquely heavy loads including custom petrochemical reactor vessels. Disclosed herein are solutions that are able to distribute the weight of elongated heavy loads between two or more cranes such that a single crane is never required to carry the entire weight of the load.

Figures 2A, 2B:
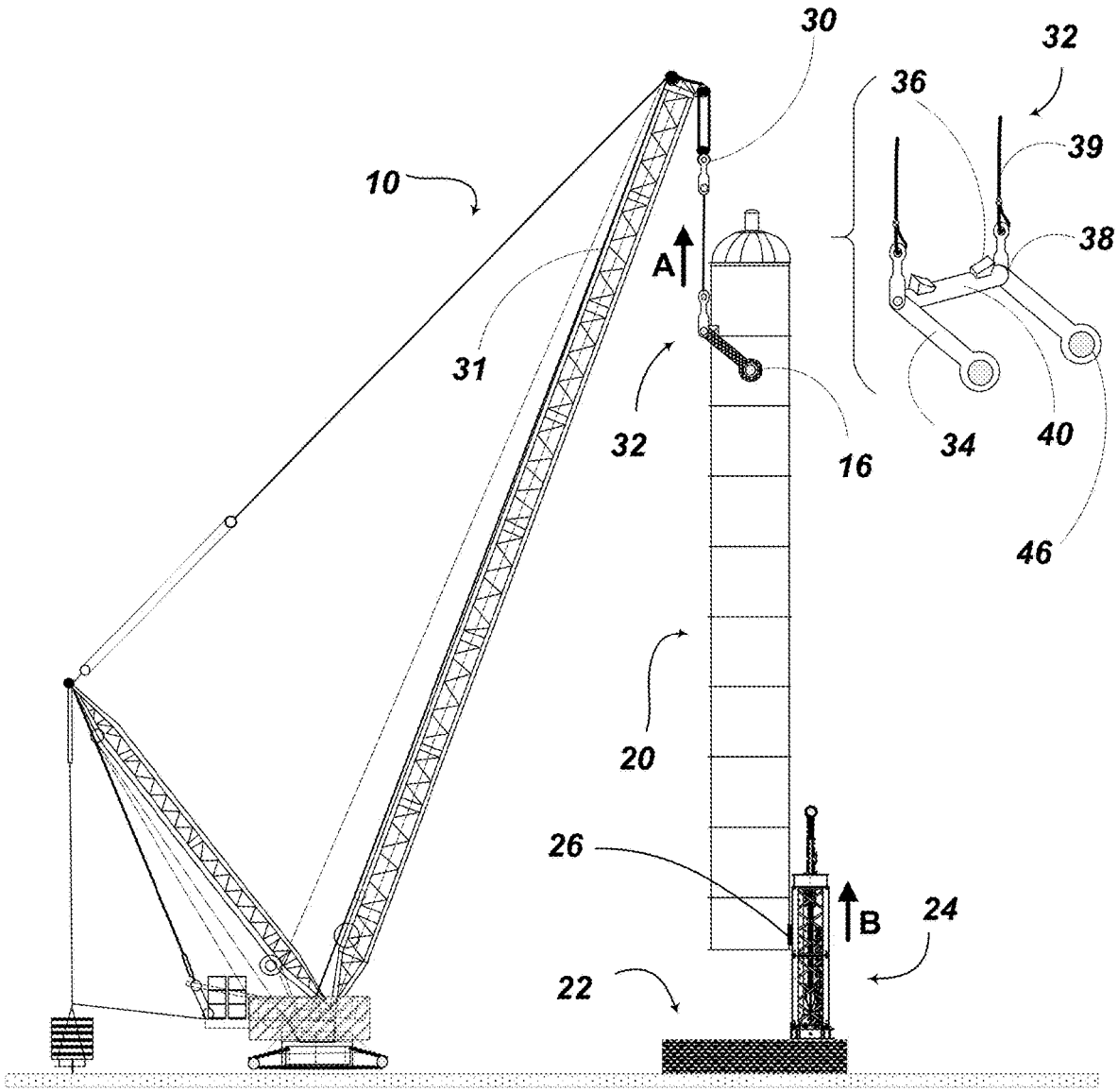
FIG. 2A illustrates one embodiment of a weight distribution hoisting frame according to an aspect of the invention in position on a reactor vessel.
FIG. 2B illustrates an enlargement of the weight distribution hoisting frame of FIG. 2A in an isometric view.

One such solution is depicted in FIGS. 2A and 2B. One embodiment of a weight distribution hoisting frame 32 is depicted in FIG. 2B. In the depicted embodiment, the frame 32 includes a spreader bar 40 that separates a pair of trunion attachment arms 34. A pair of cradling chucks 36 are affixed to spreader bar 40. The cradling chucks 36 are dimensioned to closely oppose outer walls of the load and, where the load is cylindrical, adapt the cylindrical shape of the vessel to the straight spreader bar and thus prevent shifting. Each trunion attachment arm 34 includes a trunion capture hole 46 that is dimensioned to slide over the midline trunions 16 of the reactor vessel as shown in FIG. 2A. The weight distribution hoisting frame 32 ultimately attaches to the main crane lifting cable 31. Such attachment may be via a plurality of cables 39 that ultimately connect to a mechanism such as multi-sheave main block 30. Due to the relatively short length of the trunion attachment arms, the spreader bar cannot move over a top of the vessel but will be seated against a side of the vessel. Significantly, the hoisting frame acts to insure that at least two cranes always share the total weight of the load. At least one further tailing crane such as the depicted tower crane 24 is affixed to the load via tailing lug 26. Although the depicted tailing crane is a tower crane, it could also be a crawler crane such as main crane 10. Due to the weight distribution offset, the main crane will provide load bearing from lift point A while the tailing crane will provide load bearing from lift point B.

Thus for example, reactor vessel 20 might have a weight of 1000 tons. Using prior art technology, the main crane would be required to have at least a 1000 ton capacity in order to be able to support the full weight of the vessel during at least a portion of its installation process, however brief. Using the weight distribution hoisting frame of the present invention, such a 1000 ton tower would be safely installed using two cranes neither of which are rated for 1000 tons. For one non-limiting example, the main crane might be calculated to carry a total weight of 600 tons, while the tailing crane might be calculated to carry 400 tons of the load.

Figure 3A:
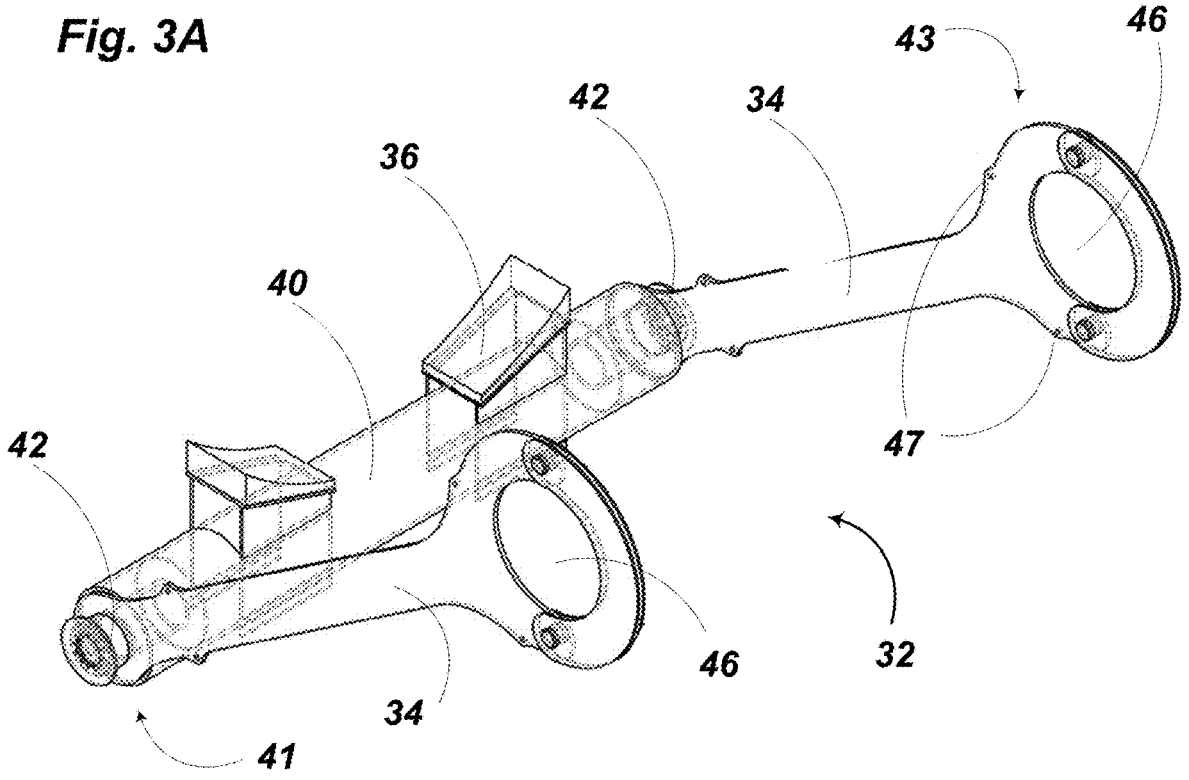
FIG. 3A illustrates a weight distribution hoisting frame according to one embodiment of the present invention in an isometric view.

FIG. 3A depicts an isometric view one embodiment of a weight distribution hoisting frame. In the depicted embodiment, the weight distribution hoisting frame 32 includes a pair of trunion attachment arms 34 that have distal and proximal ends respective to a lift position. The distal ends 43 of the trunion attachment arms have holes 46 that are dimension to fit over upper lift trunions that are located on opposite sides of the load. The trunion attachment arms are separated at a proximal end 41 by a spreader bar 40 that is designed to approximate an outer width of the load. A pair of cradling chucks 36 are affixed to spreader bar 40. The cradling chucks 36 are dimensioned to closely oppose outer walls of the load and prevent shifting and denting. In the depicted embodiment, greased bearing bush 42 movably affixes the trunion attachment arms 34 to the spreader bar 40. Alternatively an axle passing through the spreader bar from one arm to the other could be employed. In the depicted embodiment, the cables that ultimately connect to a lifting mechanism will be attached at the locations of the pair of bearing bushes 42, which are at the lift position.

Figure 3B:
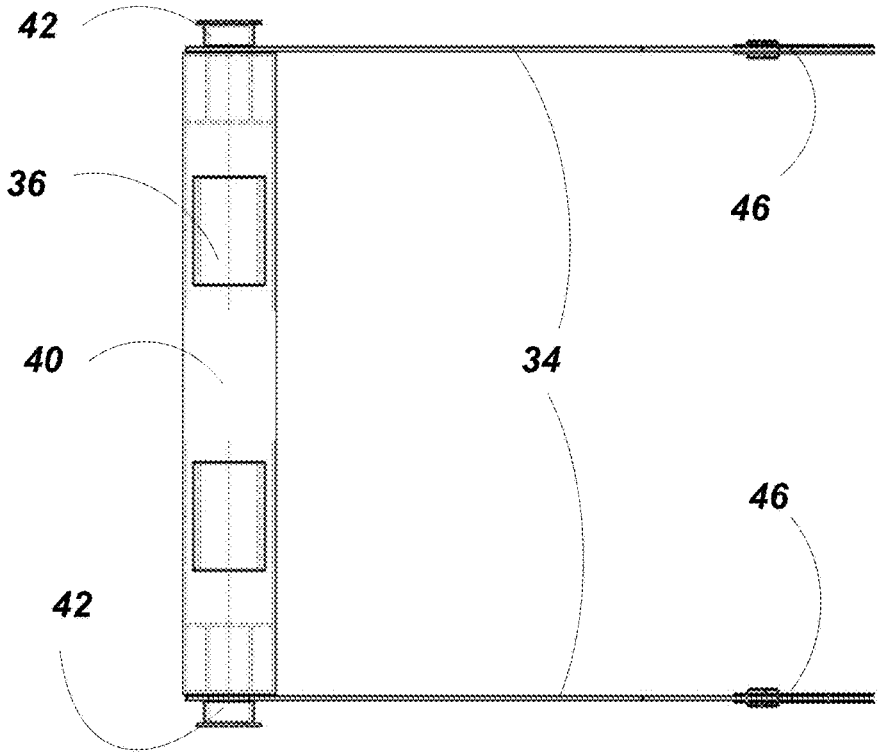
FIG. 3B illustrates the weight distribution hoisting frame of FIG. 3A in a plan view.

Optionally, the trunion attachment arms may include attachment openings 47 for a trunion release cable or chain. FIG. 3B depicts the weight distribution hoisting frame of FIG. 3A in a plan view perspective.

Figure 4A:
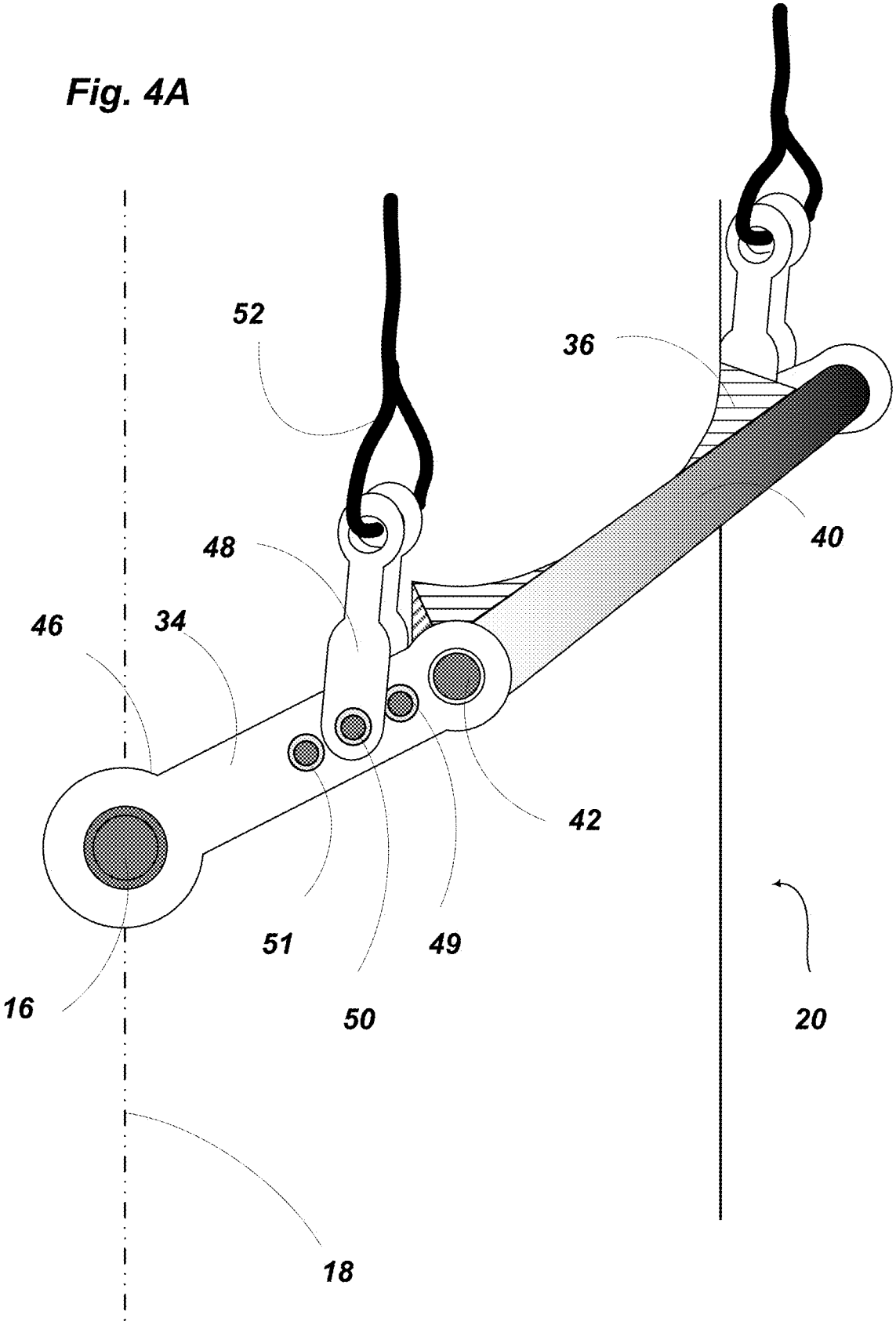
FIG. 4A illustrates another embodiment of a weight distribution hoisting frame in an isometric view in position against a reactor vessel.
Figure 4B:
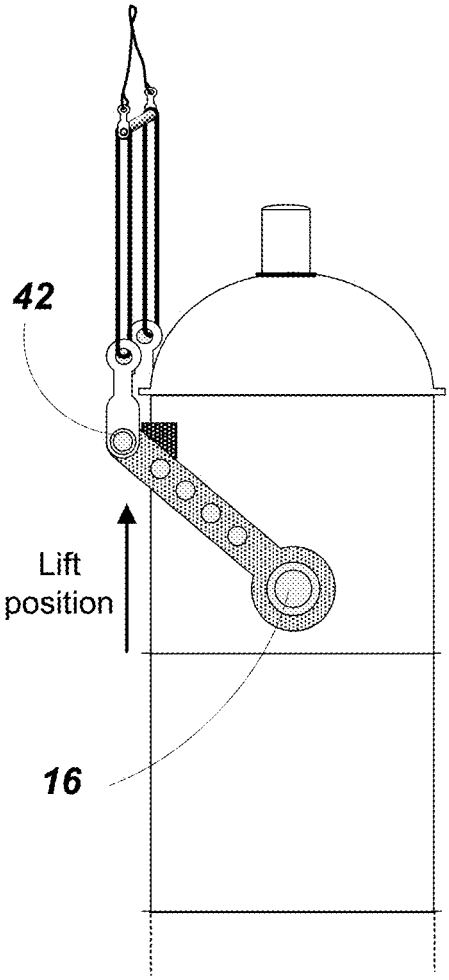
FIG. 4B illustrates the lift position of a weight distribution hoisting frame where the lift is at a farthest lateral position relative to the central lifting trunion.
Figure 4C:
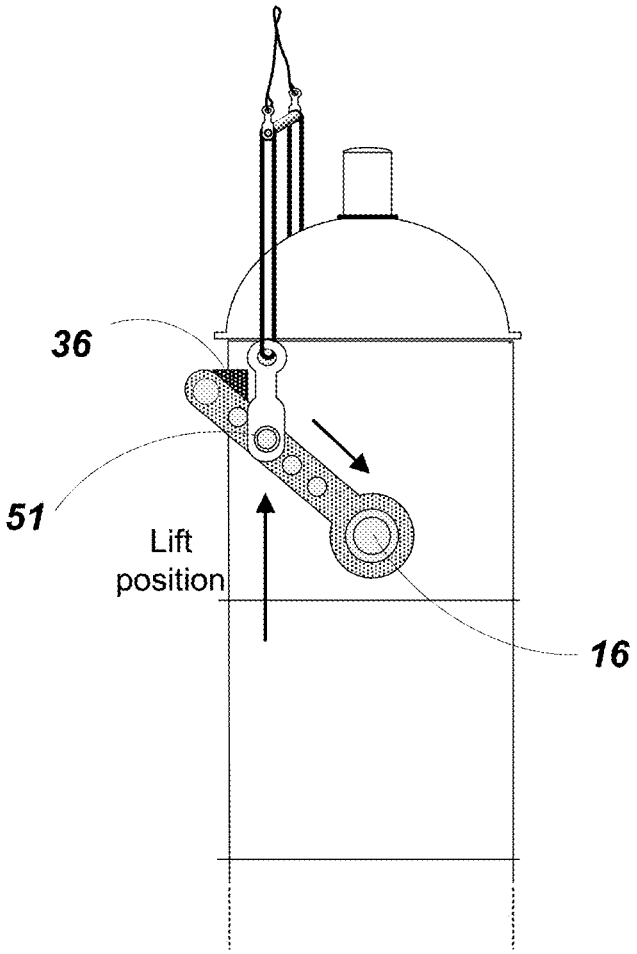
In FIG. 4C, the lift position is shifted inward towards the central trunion.

FIG. 4A depicts an isometric view of an alternative embodiment of a weight distribution hoisting frame against a reactor vessel 20 wherein the point of lift is moved inward toward the trunion 16 which is mounted on a midline 18 of vessel 20. In the depicted embodiment, the frame includes a spreader bar 40 that separates a pair of trunion attachment arms 34. As before, a pair of cradling chucks 36 are affixed to spreader bar 40. In the depicted embodiment, links or shackles 48 swingably attach the trunion attachment arms 34 to lift cable 52. Again in this embodiment, the load lift point will be displaced outward from the midline 18 and towards the side of the vessel that rests against chucks 36 affixed to spreader bar 40. Different lift attachment holes 49, 50 or 51 may be selected depending on the calculated load desired for the main crane and the tail crane. FIGS. 4B and 4C depict the shift in lift position depending on selection of different lift attachment points. As an alternative to a straight spreader bar with form fitting chucks that can be variously position to accommodate different vessel diameters, the spreader bar may be designed with a bespoke central curve that is dimensioned to fit against the specific load dimension.

Figure 5:
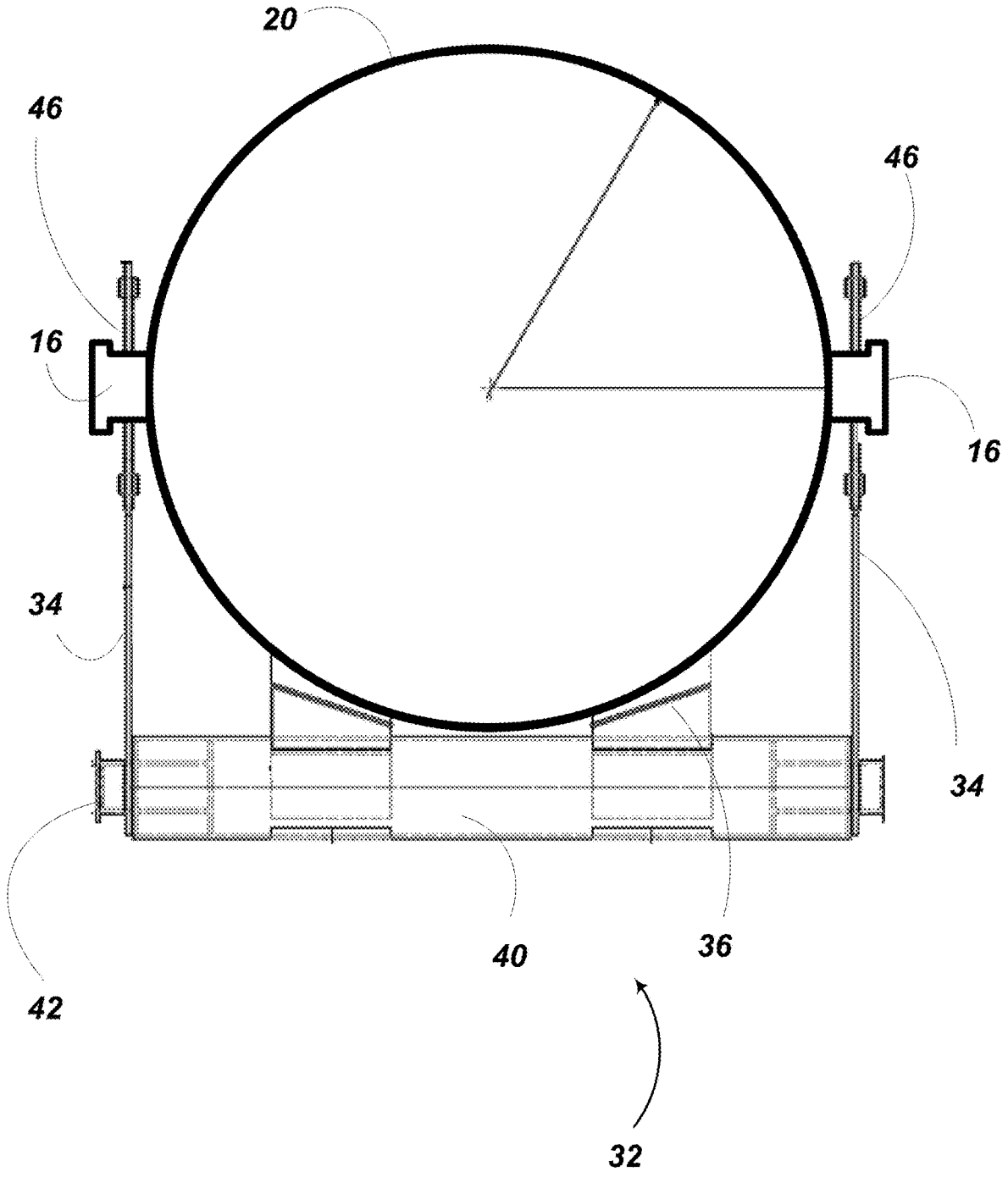
FIG. 5 illustrates one embodiment of a weight distribution hoisting frame in a plan view as it would be in position against a reactor vessel.

FIG. 5 depicts a plan view of an embodiment of a weight distribution hoisting frame 32 against a reactor vessel 20. In the depicted embodiment, the frame includes a spreader bar 40 that separates a pair of trunion attachment arms 34. Each trunion attachment arm 34 includes a trunion capture hole 46 that is dimensioned to slide over the pair of trunions 16 of reactor vessel 20.

Figure 6:
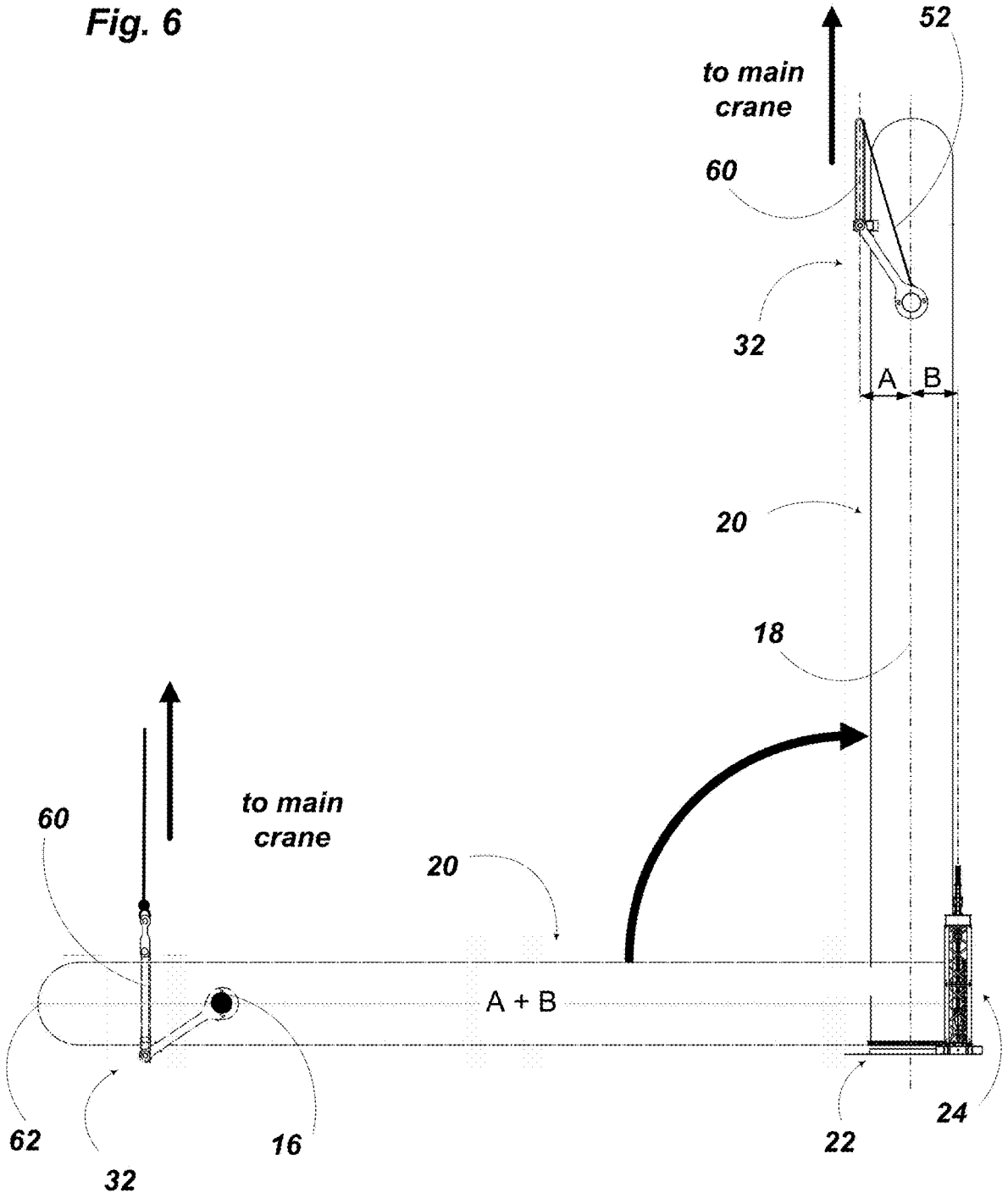
FIG. 6 illustrates an uplifting of a reactor vessel from horizontal to upright using a weight distribution hoisting frame according to one embodiment of the present invention in a side view.

FIG. 6 depicts one embodiment of a lifting operation that uses a main crane (not shown) and a pair of tower tail cranes 24 only one of which is shown. Reactor vessel 20 arrives to near the placement pad 22 in a generally horizontal position. The weight distribution hoist frame 32 is placed in position capturing trunions 16. The total weight of the reactor vessel is A+B. In the depicted embodiment, trunion attachment arms 34 are connected to the main crane lift cable through a mechanism such as multi-sheave block 60. As the vessel is raised as shown with the curved arrow, the multi-sheave block 60 moves over the top of the reactor vessel. The main crane carries load A, while the tail crane carries load B as shown over the reactor vessel in upright position where it is seen that the distance A (between a longitudinal lift line running through the center of the hoist frame spreader bar and midline 18) is greater than distance B (between a longitudinal lift line running through the center of the tail crane and midline 18).

Figure 7:
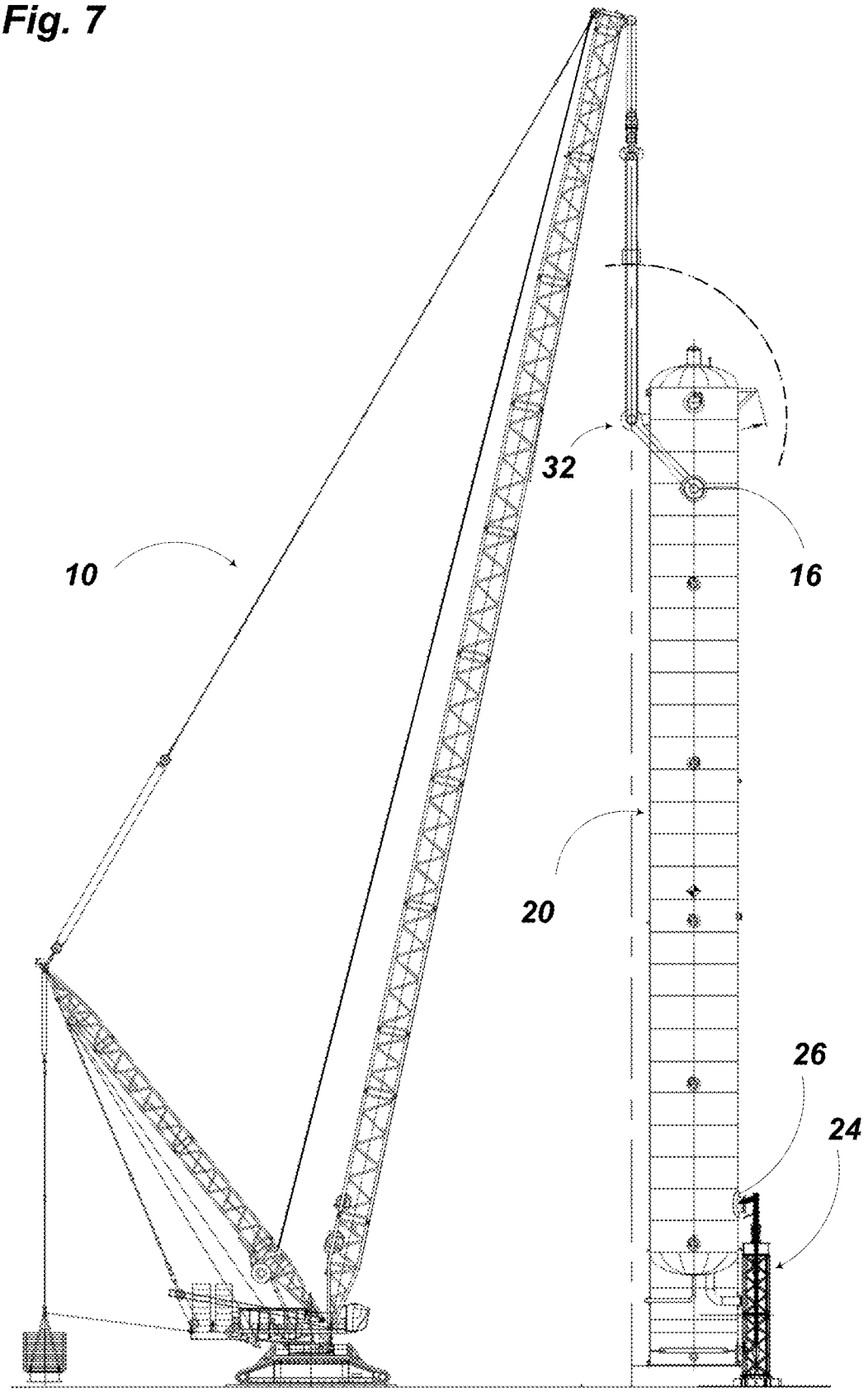
FIG. 7 illustrates positions of a main crane and a tailing crane in position in relation to a reactor vessel that is embraced by weight distribution hoisting frame according to one embodiment of the present invention in a side view.
Figure 8:
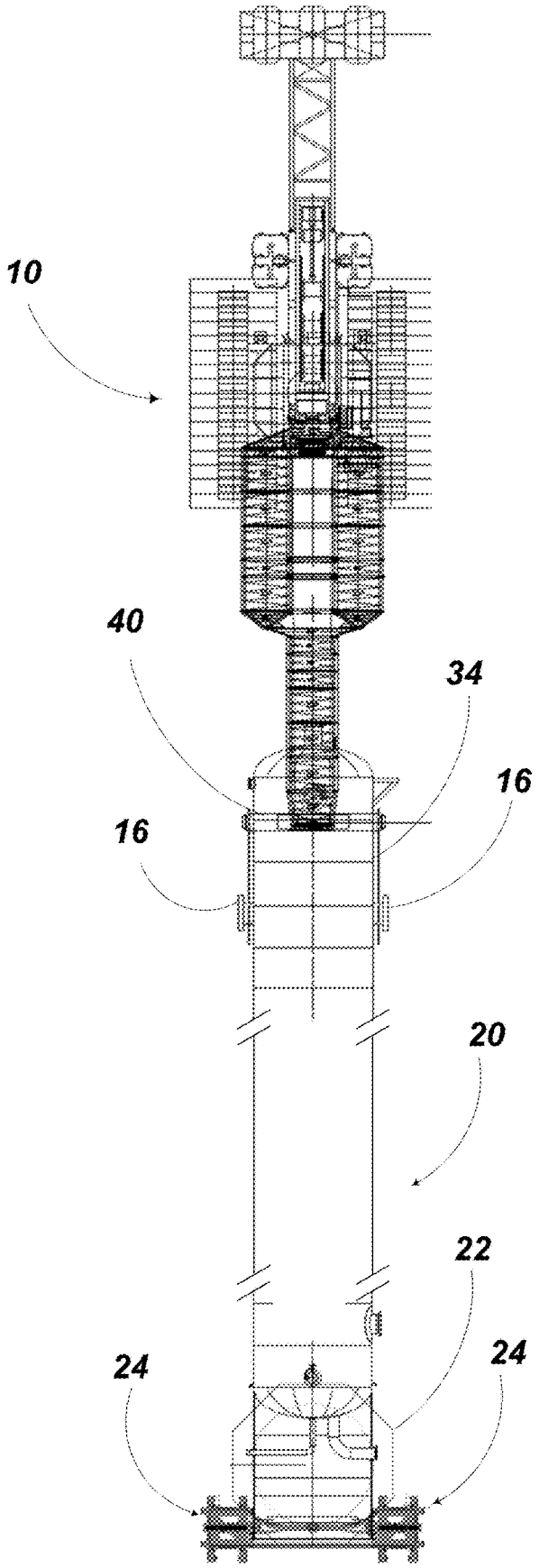
FIG. 8 illustrates positions of a main crane and a pair of tailing cranes in position in relation to a reactor vessel that is embraced by a weight distribution hoisting frame according to one embodiment of the present invention in a partial plan view.

FIG. 7 provides another depiction of a relationship between a main crane 10 and a tail crane 24 with use of a weight distribution hoist frame 32 in position on reactor vessel 20. FIG. 8 provides a plan view of showing the relative position of two tower cranes 24 where such are employed in relation to placement pad 22.

Figure 9:
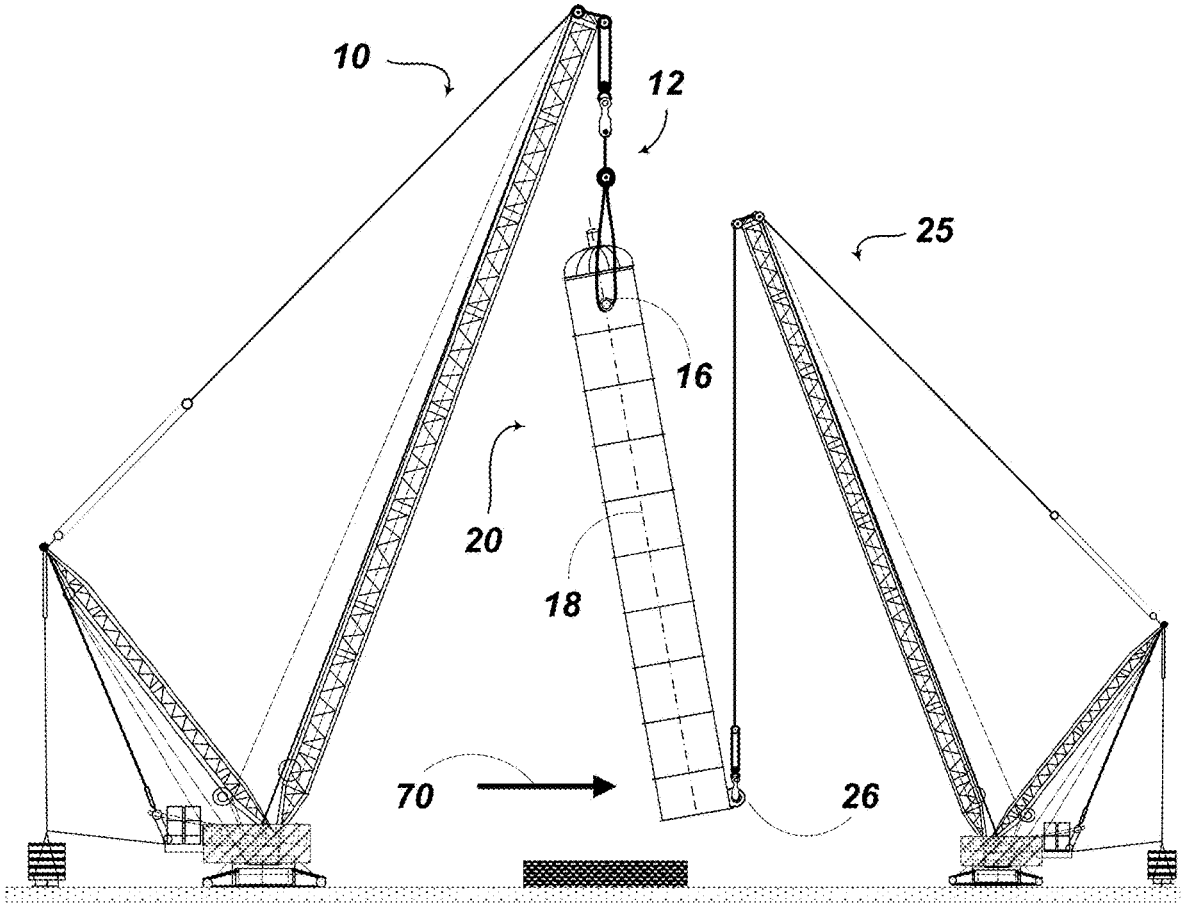
Fig. 9 PRIOR ART
FIG. 9 illustrates a lifting of a reactor vessel by a main and tail crane using prior art technology.

FIG. 9 demonstrates a prior art lifting operation using two crawler cranes. During at least a portion of such a lift, tail crane 25 carries a portion of the total load of vessel 20. However, when the load becomes closer to upright, the majority of the weight will be carried by the main crane until the full upright position where the main crane carries 100% of the load. Indeed, depending on the outward position of the tail crane, lifting by the tail crane at the end of upright positioning would tend to pull the bottom of the reactor vessel toward the tail crane in direction 70 and off of vertical rather than providing the required upward lift that would be required to share the weight of the reactor vessel.

Figure 10:
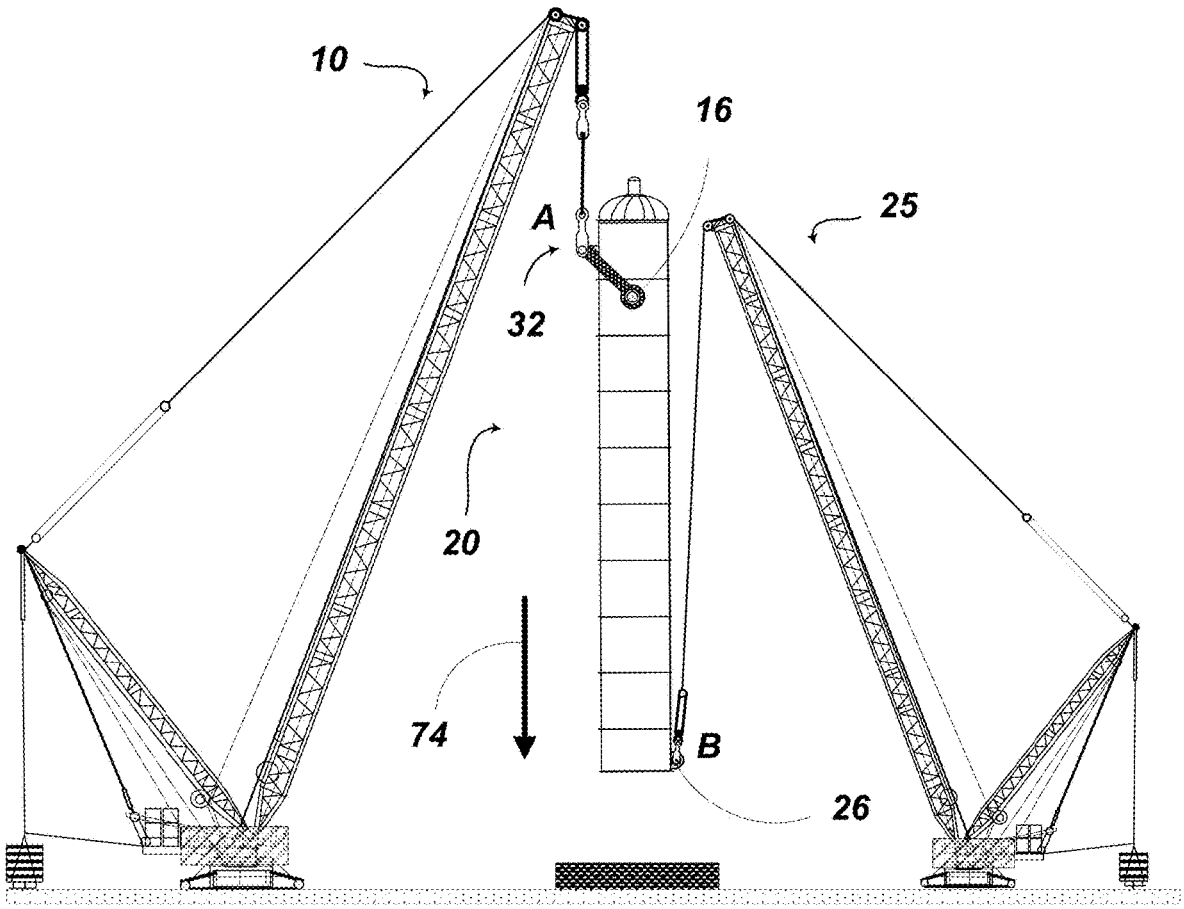
FIG. 10 depicts an upright position of the reactor vessel as the tail crane continues to bear a portion of the load using a weight distribution hoist frame according to an embodiment of the invention.

In contrast, as depicted in FIG. 10, when weight distribution hoist frame 32 as provided herein is used, tail crane 25 will pull the reactor vessel via attachment at tail lug 26 toward vertical and will always carry a portion of the total load of vessel 20. Thus, the center of gravity (COG) will always lie between the two lift points A and B of the main and tail crane(s) respectively throughout the installation process even as the load approaches and achieves an upright position as it is lowered downward in direction 74.

Figure 11:
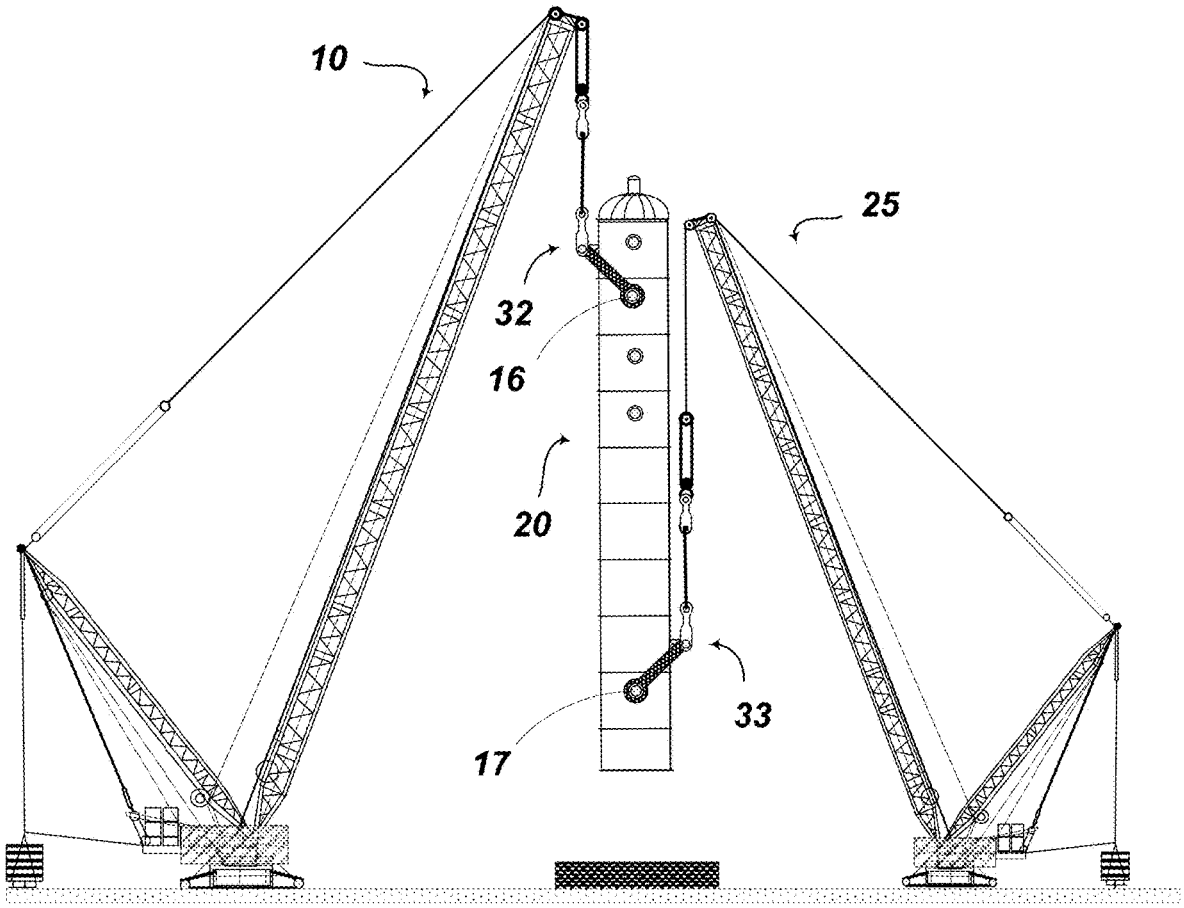
FIG. 11 depicts an embodiment using head and tail weight distribution hoist frames.

FIG. 11 depicts an alternative embodiment using top and tail weight distribution hoist frames. Tail weight distribution hoist frame 33 would be attached to a pair of tail trunions 17, each member of the pair of tail trunions 17 on contralateral sides of vessel 20.

Figure 12A:
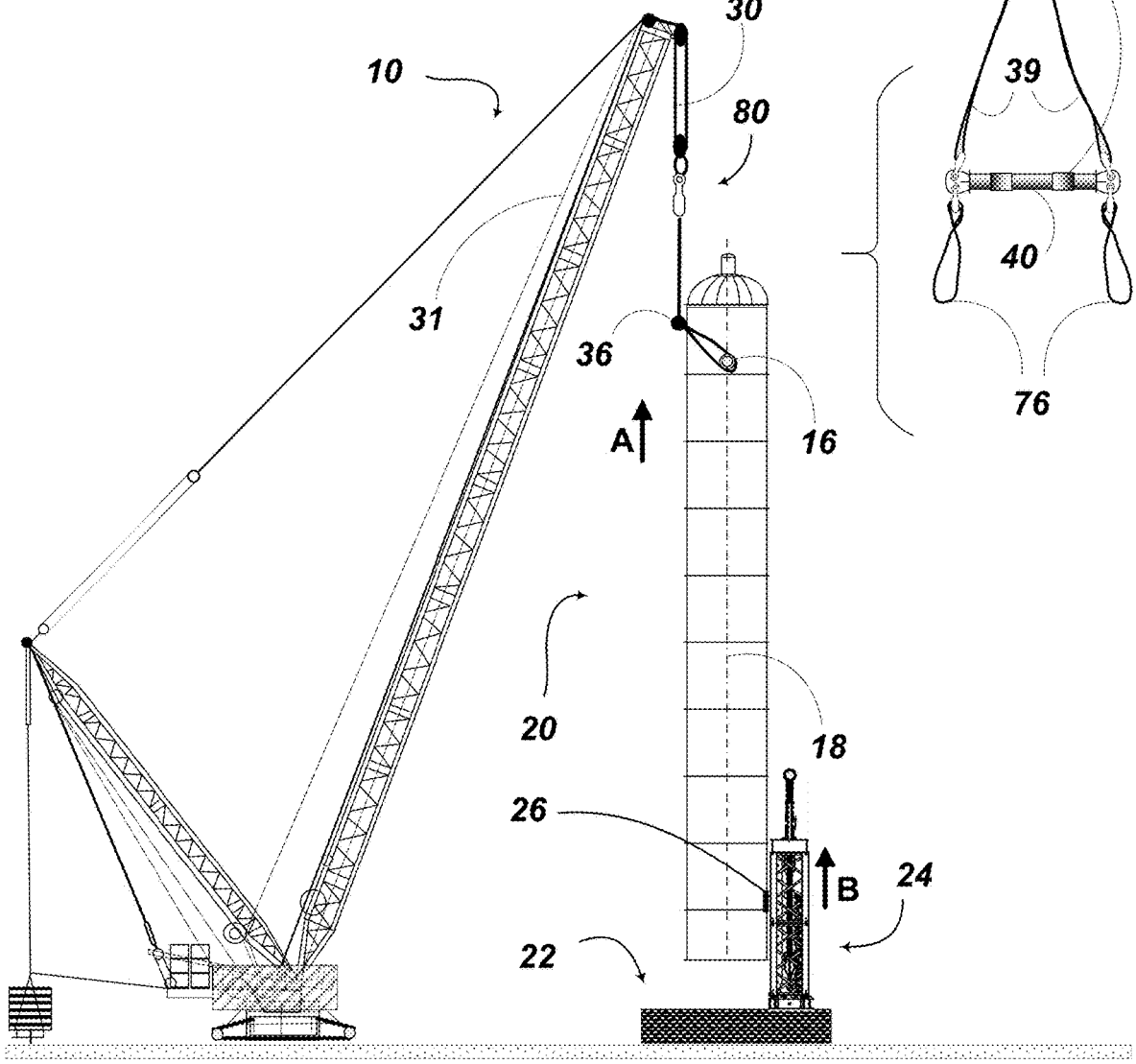
FIG. 12A illustrates one embodiment of a weight distribution hoisting frame including trunion capture cables in position on a reactor vessel.
Figure 12B:
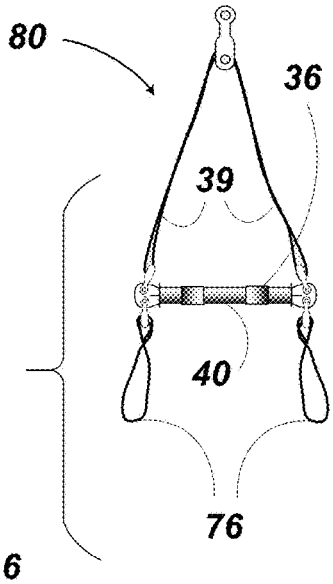
FIG. 12B illustrates an enlargement of the weight distribution hoisting frame of FIG. 12A in an isometric view. In this embodiment the spreader bar is affixed to the vessel lift trunions via cabling in lieu of rigid attachment arms.

FIG. 12A illustrates an alternative embodiment of a weight distribution hoisting frame 80 in position on a reactor vessel. FIG. 12B illustrates an enlargement of the weight distribution hoisting frame 80 of FIG. 12A in an enlarged isometric view. In this embodiment the spreader bar is affixed to the vessel lift trunions via cabling 76 in lieu of rigid attachment arms. Cabling 76 is dimensioned so that the distal ends of the cables making up cabling 76 loop over lift trunions 16 but the cabling is sufficiently short such that spreader bar 36 that connects between the two arms of cabling 74 cannot move over the top of vessel 20 during a lift but rather spreader bar 36 rests against a side of vessel 20. A pair of cradling chucks 36 are affixed to spreader bar 40. The cradling chucks 36 are dimensioned to closely oppose outer walls of the load and, where the load is cylindrical, adapt the cylindrical shape of the vessel to the straight spreader bar and thus prevent shifting. The weight distribution hoisting frame 80 ultimately attaches to the main crane lifting cable 31 such as via a plurality of cables 39 that ultimately connect to a mechanism such as multi-sheave main block 30. In operation, the lift position A of crane 10 is offset from of a midline 18 of the vessel towards a side of vessel 20 during a lift. Tail crane 24, whether a platform crane or a crawler crane, relieves a portion of the total weight of the vessel. Significantly, the hoisting frame acts to insure that at least two cranes always share the total weight of the load at least at a point during the lift when the main crane would otherwise be carrying the full load. As depicted, the at least one further tailing crane such as the depicted tower crane 24 is affixed to the load via tailing lug 26. Although the depicted tailing crane is a tower crane, it could also be a crawler crane as is depicted as crane 10. Due to the weight distribution offset, the main crane will provide load bearing from lift point A while the tailing crane will provide load bearing from lift point B.

Figure 13A:
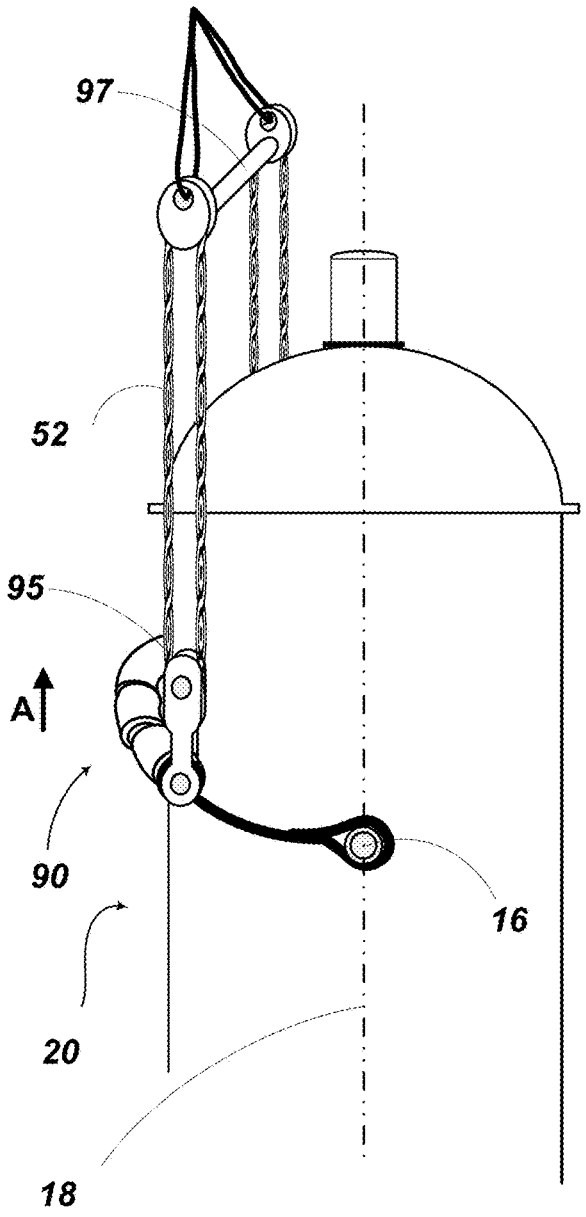
FIG. 13A illustrates an alternative embodiment of a weight distribution hoisting strap or cable in position on a reactor vessel.

FIG. 13A illustrates another alternative embodiment of a weight distribution lifting mechanism with weight distribution hoisting strap or cable 90 in position on a reactor vessel. Links or shackles 48 swingably attach weight distribution hoisting strap or cable 90 to lift cable 52.

Figure 13B:
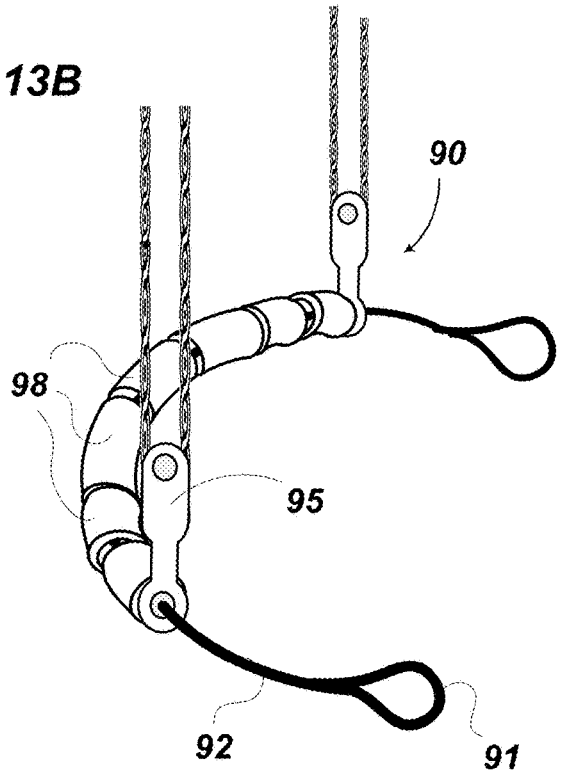
FIG. 13B illustrates an enlargement of the weight distribution hoisting strap or cable of FIG. 13A in full view.

FIG. 13B illustrates an enlargement of the weight distribution hoisting strap or cable of FIG. 13A in full view. The weight distribution hoisting strap or cable 82 embraces a vessel from trunion to trunion to allow lifting and shifting of a lift position laterally from a midline 18 of the vessel. As depicted in FIG. 13B, cable or strap 92 is configured with terminal trunion capture aspects such as for example trunion capture loops 91. The total length of the cable or strap is short enough that the strap cannot pass over a top of the vessel to be lifted but rather causes a lift position to reside against a side of the vessel. Lift attachment mechanisms 95 are provided at positions that allow the lift cables 52 to clear the sides of the vessel as separated by an upper spreader bar 97. In the depicted embodiment, the lift attachment mechanism 95 is directly attached to the weight distribution hoisting strap or cable.

Figure 13C:
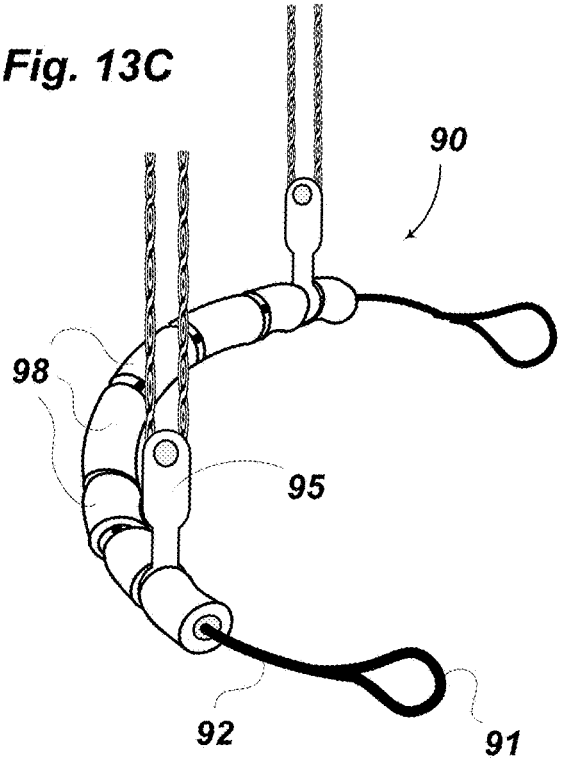
FIG. 13C depicts a plurality of bumpers "strung" on the cable wherein a location of lift attachment mechanisms can be adjusted through placement between bumpers.

In other embodiments (not shown) the lift attachment mechanism is disposed around a bumper such as for example via a sleeve to which a lift loop is attached. A number of lift attachment mechanisms can be envisioned, each of which result in operation in a lift position being offset from a midline 18 of a load to be lifted. In the depicted embodiment of FIG. 13B, strap or cable 92 is fitted with one or more bumpers 98. The bumpers can be formed of any suitable material and any suitable dimension that will provide protection against denting of the load by the hoisting strap or cable. In one embodiment a plurality of disks, sleeves, blocks or tire like bumpers composed of a shock absorbing material such as for example rubber, nylon, polyester, polyurethane, and combinations thereof are strung or mounted on the strap or cable 92 to provide protection from denting of the vessel to be lifted. Using a plurality of bumpers "strung" on the cable, the location of the lift attachment mechanism can be adjusted through placement between bumpers as shown figuratively in FIG. 13C. In other embodiments, the lift strap or cable is thickly coated or wrapped to provide cushioning of the load.

While this invention has been described with reference to illustrative embodiments, this description is not intended to be construed in a limiting sense. Various modifications and combinations of illustrative embodiments, as well as other embodiments of the invention, will be apparent to persons skilled in the art upon reference to the description. It is therefore intended that the appended claims encompass such modifications and enhancements.

We claim:

1. A weight distribution hoisting frame for lifting of a vessel by crane, the frame comprising a spreader bar mounted between and separating a first trunion attachment arm and a second trunion attachment arm, each of the first and second trunion attachment arms having a proximal end that is rotatably affixed to an end of the spreader bar and each of the first and second trunion attachment arms comprising a lift cable attachment site and a distal end having a trunion capture hole, wherein each of the first and second trunion attachment arms are dimensioned to hold the spreader bar against a side of the vessel and prevent the spreader bar from passing over a head of the vessel and wherein the hoisting frame is adapted and dimensioned to provide a displacement of a lift position of the vessel away from a vertical midline position and toward the spreader bar which is adapted to be disposed against a side of the vessel during lifting of the vessel.

2. The weight distribution hoisting frame of claim 1, wherein the trunion capture hole is an openable split ring that includes a trunion release cable or chain attachment.

3. The weight distribution hoisting frame of claim 1, wherein the spreader bar is cylindrical.

4. The weight distribution hoisting frame of claim 1, wherein the first and second trunion attachment arms are rotatably affixed to the rigid spreader bar by a bearing bush.

5. The weight distribution hoisting frame of claim 1, wherein the first and second trunion attachment arms are rotatably affixed to the spreader bar by an axle passing through the spreader bar and connecting the first trunion attachment arm to the second trunion attachment arm.

6. The weight distribution hoisting frame of claim 1, wherein links or shackles are swingably affixed to the first and second trunion attachment arms at the lift cable attachment sites.

7. The weight distribution hoisting frame of claim 1, wherein the first and second trunion attachment arms comprise a plurality of lift cable attachment sites disposed between the distal and proximal ends of the attachment arms and wherein selection of a given attachment hole site on each of the first and second trunion attachment arms shifts a lift position of the vessel respective to a midline of the vessel.

8. The weight distribution hoisting frame of claim 1, wherein the spreader bar comprises cradling chucks dimensioned to fit against the vessel and keep the vessel centered on the spreader bar.

9. A weight distribution hoisting frame for use in lifting a vessel by crane, the weight distribution hoisting frame adapted to shift a center of gravity of the vessel, the frame comprising:

first vessel attachment arm and a second vessel attachment arm, wherein each of the first and second vessel attachment arms include at least one lift cable attachment site; and a spreader bar attached between the first and second vessel attachment arms at proximal portions of the first and second vessel attachment arms, wherein the first and second vessel attachment arms are dimensioned to position the spreader bar against a side of the vessel and prevent the spreader bar from passing over a head of the vessel, each of the first and second vessel attachment arm having a distal end respective to a lift position of the vessel, and wherein the distal end of each vessel attachment arm includes a vessel trunion capture opening.

10. The weight distribution hoisting frame of claim 9, wherein the first and second vessel attachment arms each include a plurality of lift cable attachment sites that permit selection of desired lift positions depending on a calculated load when distributing the calculated load between a first crane and a second crane.

11. The weight distribution hoisting frame of claim 9, wherein the spreader bar comprises cradling chucks positioned to rest against the side of the vessel, adapt to the shape of the vessel, and keep the vessel centered on the spreader bar without shifting.

12. The weight distribution hoisting frame of claim 9, wherein the vessel attachment arms are cables.

13. A method of lifting a load using a plurality of cranes wherein the load is heavier than the weight capacity of any individual crane of the plurality of cranes, comprising:

attaching a weight distribution hoisting frame to the load via lifting trunions affixed to a head portion of the load, wherein the weight distribution hoisting frame comprises a plurality of lift cable attachment sites and a pair of trunion capture arms that embrace the load from one side mounted trunion on the load to a contralateral side mounted trunion on the load and are dimensioned to retain the plurality of lift cable attachment sites offset from a vertical midline of the vessel;

attaching lift cables from a first of the plurality of cranes to the lift cable attachment sites on the weight distribution frame and tightening the cables whereby moving a lift position of the load away from the midline of the load and toward the lift cable attachment sites;

attaching lift cables from a second of the plurality of cranes to lifting trunions affixed to a tail portion of the load;

adjusting the relative position of each crane to keep a center of gravity of the load shared between both cranes; and moving and positioning the load with shared weight bearing by the plurality of cranes.

14. The method of claim 13, wherein the plurality of cranes are crawler cranes.

15. The method of claim 13, wherein the first of the plurality of cranes is a crawler crane and the second of the plurality of cranes is a tower crane.

16. The method of claim 13, wherein the load is a refinery reactor vessel.

* * * * *